US005263886A

United States Patent [19]

Workman

[11] Patent Number: 5,263,886

[45] Date of Patent: Nov. 23, 1993

[54] METHOD FOR TREATING SPARK PLUGS

[75] Inventor: Kenneth J. Workman, Bourbon, Ind.

[73] Assignee: Leading Edge, Incorporated, Plymouth, Ind.

[21] Appl. No.: 27,676

[22] Filed: Mar. 8, 1993

[51] Int. Cl.[5] ..... H01T 21/00

[52] U.S. Cl. ..... 445/7; 148/577

[58] Field of Search ..... 445/7; 148/577, 578

[56] References Cited

U.S. PATENT DOCUMENTS 3,008,853 11/1961 Borchers et al. ..... 148/577

3,764,401 10/1973 Hrusovsky ..... 148/577

FOREIGN PATENT DOCUMENTS 842888 7/1960 United Kingdom ..... 148/577

*Primary Examiner*—Kenneth J. Ramsey

*Attorney, Agent, or Firm*—James D. Hall; Thomas J. Dodd; R. Tracy Crump

[57] ABSTRACT

A method for treating spark plugs to increase the horsepower output of an internal combustion engine. The method involves significantly lowering the temperature of the plugs to about −300° F. and keeping the plugs at this temperature for a predetermined time. The temperature is then raised back to room temperature (about 72° F.). After the treated plugs have reached room temperature they may be slowly heated to about +300° F. and held at that temperature for a predetermined time before being gradually cooled back to room temperature.

8 Claims, 2 Drawing Sheets

METHOD FOR TREATING SPARK PLUGS

FIELD OF THE INVENTION

This invention relates to spark plugs and will have application to thermal cycling treatment of spark plugs and the like.

BACKGROUND OF THE INVENTION

Controlled thermal cycling treatments have been applied to various alloy metals for a number of years. The most common metals to receive treatment are steel alloys, which normally include two or more alloying elements such as cobalt, nickel, molybdenum, titanium, aluminum, chromium, manganese, magnesium, tungsten and vanadium. It has been found that thermal cycling treatment of such alloy metals improves their resistance to normal wear and tear, which is especially useful in treatment of tools constructed of such metals.

Thermal cycling treatments have also been used to treat electrical power transmission equipment such as wires, cables, electric motors, etc. Such treatments have also recently been discovered by the inventors to be beneficial in the copper welding electrode field. Welding electrodes so treated have exhibited improved voltage conduction and current.

A typical thermal cycling process involves lowering the temperature of the article to be treated to temperatures exceeding −300° F. (−185° C.). The article is then allowed to recover until its temperature is equivalent to its ambient surroundings, or about 72° F. (22° C.). In some cases, the article is then raised to about +300° F. (149° C.) and then allowed to cool gradually back to ambient temperature.

In treatment of alloyed steel components, such thermal cycling processes affect the wearability of the metal by four known mechanisms: conversion of significant amounts of austenite to martensite; precipitation hardening which increases Rockwell hardness; formation of fine carbide particles; and residual stress relief.

SUMMARY OF THE INVENTION

The process of this invention involves the use of a controlled thermal cycling process on automobile spark plugs. Typically, the process involves first lowering the temperature of the spark plug to about −300° F. and then holding the temperature of the plug at that level for a fixed time. The spark plugs are then slowly warmed until they reach room temperature, about 72° F. In some embodiments of the process the treated spark plugs are then gradually heated to about +300° F., allowed to remain at that temperature for a fixed time, then cooled gradually back to room temperature.

Spark plugs treated by this process exhibited improved electrical conductivity. As a result, treated spark plugs generated a hotter spark when used in an internal combustion engine, which resulted in improved fuel combustion in the cylinders. More horsepower was generated and fuel economy was improved by use of the treated spark plugs.

It is therefore an object of this invention to provide for a novel process of treating spark plugs.

Another object is to provide for a spark plug treatment process which enables the spark plug to generate a hotter spark during use in a vehicle engine.

Another object is to provide a thermal cycling treatment for spark plugs which improves the electrical conductivity of the spark plugs.

Other objects will become apparent upon a reading of the following description.

DESCRIPTION OF THE PREFERRED EMBODIMENT

Figure 1:
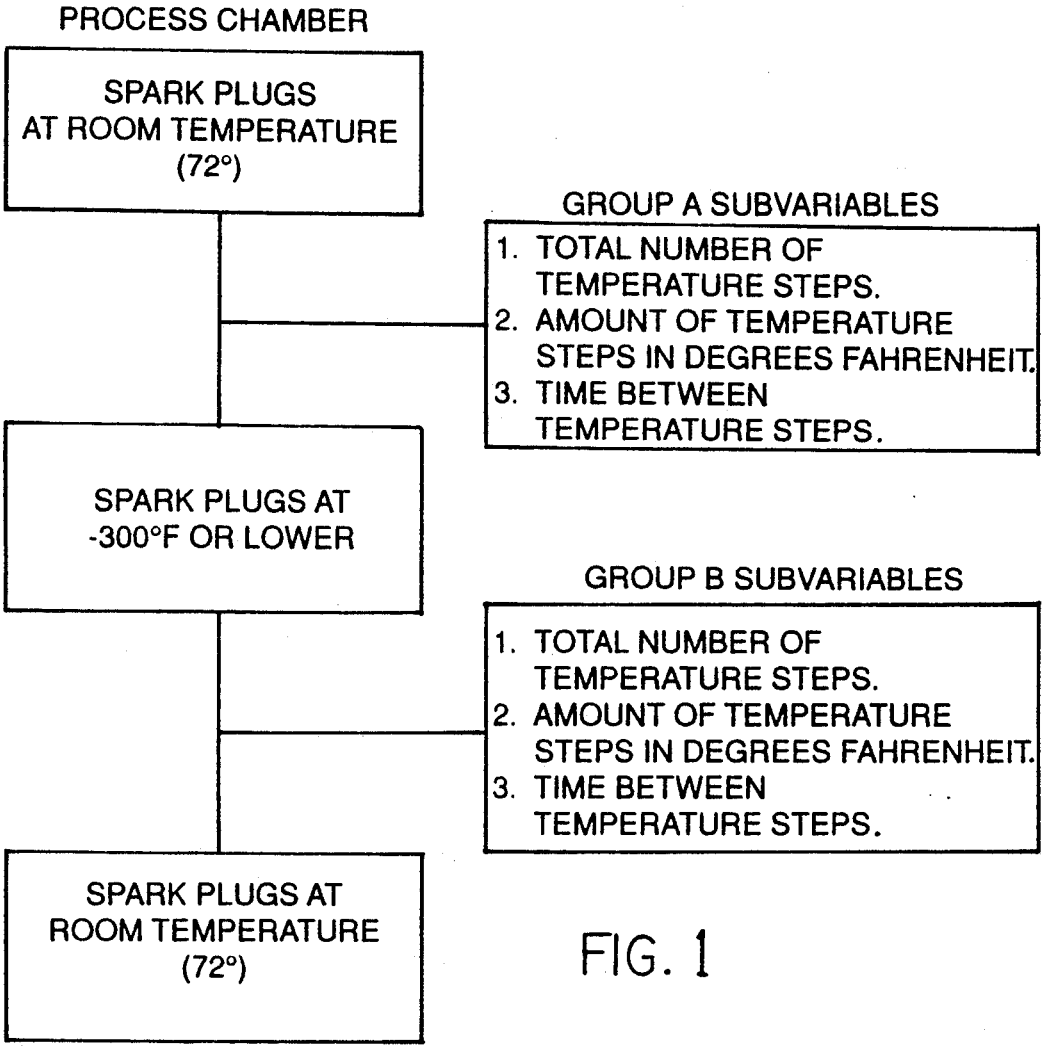
FIG. 1 is a flow chart diagram illustrating the thermal cycling process of this invention.

The preferred embodiments herein described are not intended to be exhaustive or to limit the invention to the precise forms disclosed. They are chosen and described to illustrate the principles of the invention and its application and practical use to enable others skilled in the art to follow its teachings.

The process of this invention involves the controlled thermal cycling of vehicle spark plugs. While the steps of the process, particularly as they are applied to spark plugs, are unique, the machinery used in the thermal cycling process is well-known to those skilled in the art and will not be described in detail in the interests of clarity.

Generally, the method involves cryogenically treating spark plugs for internal combustion engines. Spark plugs have wide range application in internal combustion engines and their composition and function is well-known. A typical spark plug includes a copper-based nucleus electrode surrounded by insulation and an insulating cover, a resistor and a ground electrode which is exposed and slightly spaced by an air gap from the terminal end of the nucleus electrode. Electric current from the vehicle ignition system flows through the nucleus electrode across the air gap to the grounding electrode. The heat generated by the flow of current across the gap serves to ignite the fuel mixture in the engine cylinders.

The efficiency of fuel combustion in the cylinders is directly tied to the heat generated by the spark plugs. As the plugs wear, their ability to conduct electricity erodes and fuel efficiency and engine horsepower are reduced. Frequent replacement of conventional spark plugs is necessary, particularly in auto racing engines where maximum horsepower and fuel efficiency must be retained at all times.

Spark plugs treated with the thermal cycling process of this invention have demonstrated the ability to conduct greater amounts of electricity for longer periods of time. This allows the spark plugs to burn at hotter temperatures more consistently than untreated plugs. As a result, engines fitted with treated plugs exhibited gains in both horsepower and fuel combustion efficiency.

The treatment process generally involves the gradual lowering of the temperature of the plugs, preferably to cryogenic levels, about −300° F. (−185° C.) or lower. After the plugs have attained the desired temperature, they are held at that level for a predetermined time, usually about twelve hours. The plugs are then gradually raised back to room temperature, about 72° F. (22° C.).

After the plugs have reached room temperature, they may be heat treated by gradually raising the temperature to +300° F. (149° C.), holding the plugs at that temperature for a predetermined time, usually about two hours, then gradually cooling the plugs until room temperature is achieved.

The process above described is generally performed with machinery and equipment common to cryogenic processing. The spark plugs are placed in a treatment chamber which is connected to a supply of cryogenic fluid such as liquid nitrogen or another like fluid. Exposure of the chamber to the cryogenic fluid lowers the temperature of the spark plugs until the desired temperature is achieved. Control devices of a common nature are employed to ensure that the cooling is gradual which averts damage to the spark plugs which may occur if subjected to rapid cooling. As stated above, this machinery is well-known to those skilled in the art, and does not add to the novelty of the process. Heating of the spark plugs can also be accomplished in any common manner.

FIG. 1 illustrates in flow chart form the process of this invention in general terms. As seen in FIG. 1, the subvariables of the cooling and heating steps include the total number of temperature steps, the number of degrees changed in each step, and the time desired to attain each step.

Figure 2:
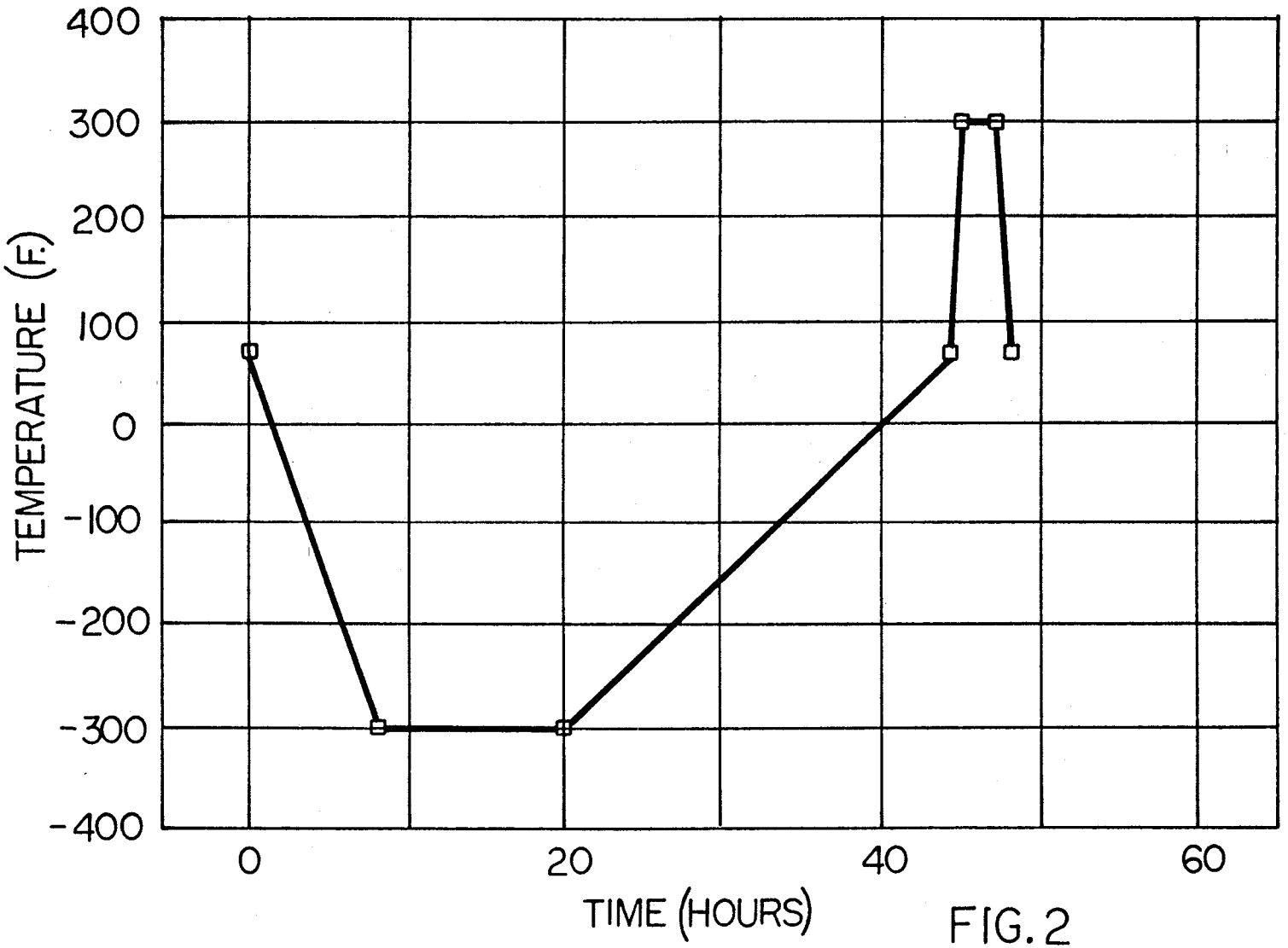
FIG. 2 is a graphical representation of the thermal cycling steps of the process.

Preferably, the subvariables are selected and programmed into a conventional microprocessor so that the cooling and heating processes are substantially linear in function as shown in FIG. 2. Linear heating and cooling ensures that the spark plugs receive the full benefit of the treatment with limited risk of damage.

As shown in FIG. 2, the detailed steps of the process involve placing room temperature (72° F.) spark plugs in the treatment chamber and gradually reducing the temperature in the chamber to about −300° F. Preferably the temperature will be lowered to at least −300° F. or lower to obtain maximum treatment effects. As shown, this temperature change (known as the ramp-down phase of the process) is preferably accomplished over a period of eight hours, or about a 46.5° F. per hour temperature drop.

The spark plugs are then kept in the cryogenic chamber at a steady temperature (about −300° F. or lower, if desired) for a period of about twelve hours. This is known as the soaking phase of the process.

When the soaking phase is complete, the temperature of the chamber is allowed to gradually warm to room temperature, preferably over a period of about twenty-four hours. This is known as the ramp up phase and raises the temperature about 15.5° F. per hour.

When the spark plugs have achieved room temperature, they may be subjected to heating to raise their temperature to about +300° F. Heating is generally accomplished much more rapidly than cooling with the plugs attaining their top temperature in about one hour.

After the spark plugs are heated to about +300° F., they are kept in the chamber at that temperature for about two hours. This is known as the heat soaking phase.

Finally, when the heat soaking phase is completed, the spark plugs in the chamber are gradually cooled to allow them to return once more to room temperature. This cool down phase is normally achieved in about one hour. When the treated spark plugs achieve room temperature, they are removed from the treatment chamber and are ready for use in an internal combustion engine.

When used in an internal combustion engine, plugs treated according to the process of this invention consistently delivered greater heat output than untreated plugs.

It should be noted that the procedures and temperature ranges recited above in no way limit the scope of this invention to the precise details given. Instead, the scope of the invention is defined by the following claims.

We claim:

1. A process for treating spark plugs comprising the steps of:

a) providing a quantity of spark plugs;

b) gradually lowering the temperature of said spark plugs to approximately −300° F.;

c) holding the temperature of said spark plugs at approximately −300° F. for a predetermined time; and d) gradually raising the temperature of said spark plugs to room temperature.

2. The process of claim 1 wherein step b) includes gradually lowering the temperature of said spark plugs over an eight hour period.

3. The process of claim 2 wherein step c) includes holding said spark plugs at approximately −300° F. for a period of approximately 12 hours.

4. The process of claim 3 wherein step d) includes gradually raising the temperature of said spark plugs over a 24 hour period.

5. The process of claim 1 and further including the following steps:

e) gradually raising the temperature of said spark plugs to approximately +300° F.;

f) holding the temperature of said spark plugs at approximately +300° F. for a predetermined time; and g) gradually lowering the temperature of said spark plugs to room temperature.

6. The process of claim 5 wherein step e) includes raising the temperature of said spark plugs over a one hour period.

7. The process of claim 5 wherein step f) includes holding said spark plugs at approximately +300° F. for approximately two hours.

8. The process of claim 5 wherein step g) includes gradually lowering the temperature of said spark plugs over a one hour period.

* * * * *